US005658169A

United States Patent [19]

Buhle et al.

[11] Patent Number: 5,658,169

[45] Date of Patent: Aug. 19, 1997

[54] ELECTRICAL CONNECTOR PART

[75] Inventors: Klaus Buhle, Schwerte; Wolfgang Mohs, Iserlohn; Wilfried Heringhaus, Herne; Peter Epe, Lennestadt; Georg Schröder, Drolshagen, all of Germany

[73] Assignee: Leopold Kostal GmbH & Co. KG, Ludenscheid, Germany

[21] Appl. No.: 523,691

[22] Filed: Sep. 5, 1995

[30] Foreign Application Priority Data

Sep. 21, 1994 [DE] Germany ..... 44 33 617.9

[51] Int. Cl.[6] ..... H01R 13/40

[52] U.S. Cl. ..... 439/595; 439/748

[58] Field of Search ..... 439/595, 842, 439/843, 851, 852, 856, 857

[56] References Cited

U.S. PATENT DOCUMENTS

| | | | |
|---|---|---|---|
| 5,281,168 | 1/1994 | Krehbiel et al. | 439/595 |
| 5,470,258 | 11/1995 | Suzuki et al. | 439/595 |
| 5,520,548 | 5/1996 | Hoter et al. | 439/595 |
| 5,522,740 | 6/1996 | Plocek et al. | 439/595 |

FOREIGN PATENT DOCUMENTS

| | | |
|---|---|---|
| 4124541 | 5/1992 | Germany . |
| 4301602 | 4/1994 | Germany . |

*Primary Examiner*—Neil Abrams
*Assistant Examiner*—Brian J. Biggi
*Attorney, Agent, or Firm*—Brooks & Kushman PC

[57] ABSTRACT

An electrical connector consisting principally of a housing of synthetic material with a plurality of receiving chambers provided therein for receiving an associated electrical connector contact element. In at least one outer housing wall of the housing is located one orifice per receiving chamber, with a locking arm disposed therein, which is integrally formed as a single piece on this outer wall of the housing. In order for it to be possible with a single operating step to release both the primary and the secondary locking and therefore to remove the electrical connector contact elements quickly and easily from their receiving chambers, a return slope is integrally formed on the free end region of each of the locking arms. In the housing at least one further access point is provided per receiving chamber and leads from the mouth region of the housing. This access point extends substantially parallel to the longitudinal direction of the receiving chamber so that a tool inserted into the housing by way of the other access point displaces the locking arm from its locking position into its release position.

7 Claims, 4 Drawing Sheets

ELECTRICAL CONNECTOR PART

TECHNICAL FIELD

The present invention relates to an electrical connector.

BACKGROUND ART

Electrical connector parts are provided in order to create, by means of their connector contact elements attached to electrical wires, an electrical connection to a counter connector part, which may be released again. The counter connector part can thus, for example, also be attached to an electrical wire or be directly connected to an electrical unit.

DE 43 01 602 C1 discloses an electrical connector part. In this electrical connector part the electrical connector contact elements are inserted in receiving chambers of the housing which is provided with a locking arm for each receiving chamber. For the purpose of so-called secondary locking each locking arm can be brought from a release position into a locking position. Furthermore, two resilient arms are integrally formed on each of the electrical connector contact elements and come to lie behind locking stops integrally formed on walls of the associated receiving chamber, so that the electrical connector contact elements located in the receiving chambers are thus held in a primarily secured manner. If an electrical connector element is to be removed from its receiving chamber a tool is inserted into the associated receiving chamber by means of corresponding access points, whereby the primary locking is released. In order to be able to remove the connector contact element from its receiving chamber it is also necessary, however, to release the secondary locking by means of a further operating step.

Furthermore, DE 41 24 541 A1 discloses an electrical connector part, in the receiving chambers of which resiliently deflectable locking arms are provided for locking inserted connector contact elements. The locking arms are integrally formed on a housing wall and come to lie with their free end against a projection of the associated connector contact elements for the purpose of locking. In order to provide secure locking a spacer block is inserted into the inner chamber of the connector part from the insertion side and, in a first position, permits resilient deflection of the locking arms and, in a second position, blocks the deflection capability of the locking arms. If a connector contact element is to be removed again from its receiving chamber, the spacer block must first be brought into its first position. Only then may a tool be inserted into the inner space of the connector part in order to deflect the locking arm and the connector contact element concerned removed from its receiving chamber. Due to a total lack of provision made in the housing and the connector contact element it is only possible with such a connector part to produce a single locking means for the connector contact elements. However, in order to release this locking, based on only one locking means, a number of operating steps are required.

SUMMARY OF THE INVENTION

It is thus an object of the present invention to develop an electrical connector part in which by means of a single operating step both the primary and the secondary locking can be released merely by the insertion of a single tool so that it is possible to remove the electrical connector contact elements quickly and easily from their receiving chambers.

This object is achieved by providing an electrical connector which has a housing and at least one receiving chamber defined therewithin for accommodating an electrical connector contact element. An orifice is located in an outer wall of the housing in communication with the receiving chamber. A locking arm is disposed within the orifice, the locking arm being integrally formed as a single piece on the outer wall of the housing. The locking arm can be brought from a release position to a locking position. In the release position, the locking arm clears a cross-sectional area of the receiving chamber. In the locking position, the locking arm narrows the cross-sectional area of the receiving chamber so that the electrical connector contact element located therewithin is held under secondary locking between an associated end stop of the receiving chamber and an associated free end of the locking arm.

Two exposed resilient arms are integrally formed on the connector contact element. The arms come to lie behind locking stops integrally formed on the walls of the receiving chamber so that the electrical connector contact element located in the receiving chamber is thereby held under primary locking.

Two access points are defined in the housing leading from a mouth region thereof and extending parallel to a longitudinal direction of the receiving chamber. The two access points are provided in such a way that a tool inserted into the housing through the two access points may force back the resilient arms of the connector contact element so that the primary locking is released.

A return slope is integrally formed on the free end region of each of the locking arms. At least one further access point is provided through the receiving chamber and leading from the mouth region of the housing, extending substantially parallel to the longitudinal direction of the receiving chamber so that the tool is inserted into the housing not only by way of the other two access points, but also by way of the at least one further access point. Thus, the tool may also come to bear against the return slope. By means of a continuing insertion movement, the tool displaces the locking arm from its locking position into its release position.

It is particularly advantageous in the use of such electrical connector parts that in spite of particularly secure locking employing two locking means, the possibility is provided in a cost-effective manner of quickly and easily removing the electrical connector contact elements.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
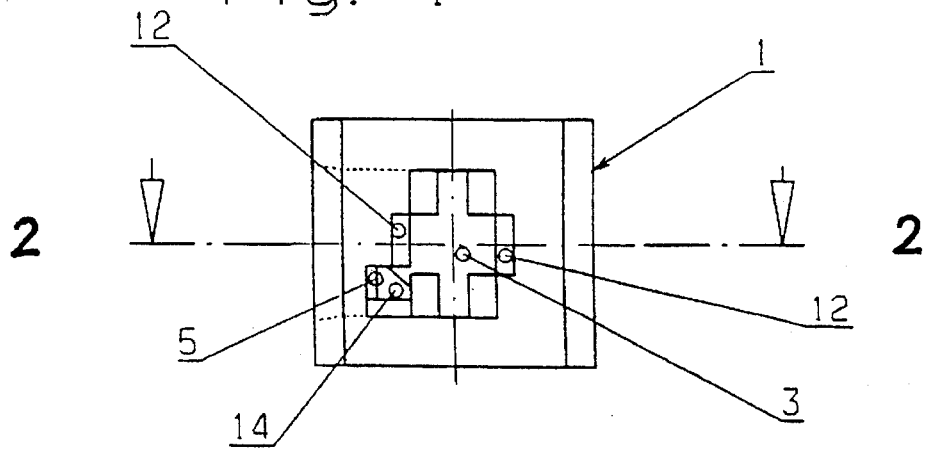
FIG. 1 illustrates a front view of an electrical connector part.
Figure 2:
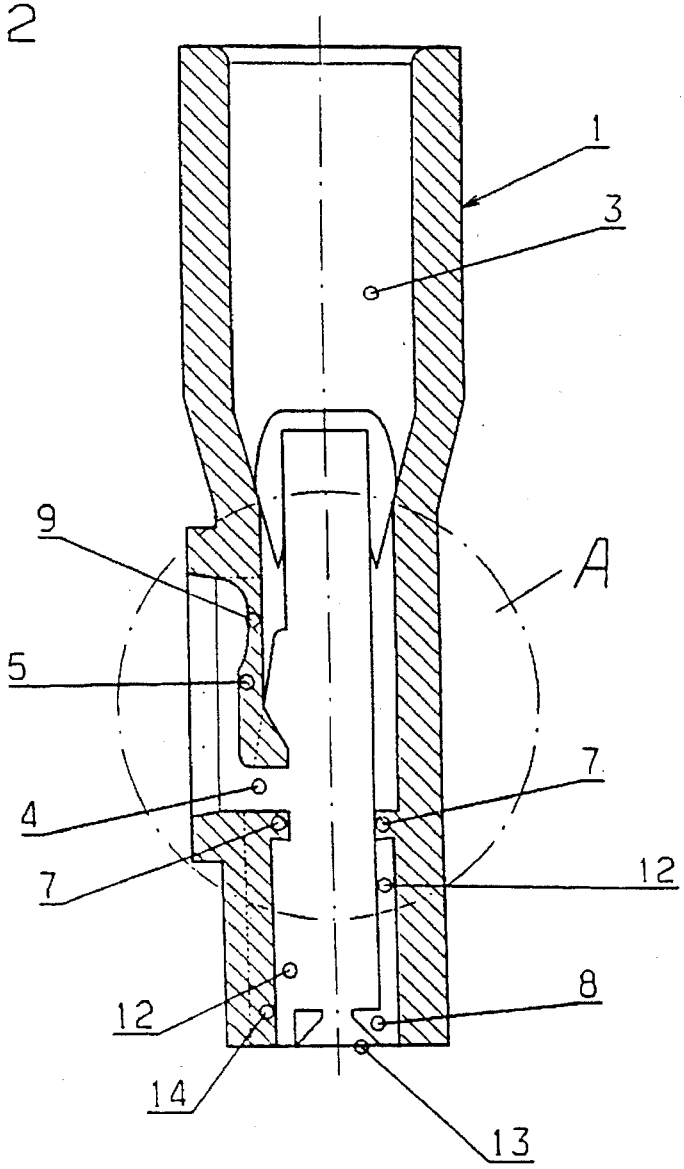
FIG. 2 illustrates a cross section through an electrical connector part in accordance with the line B—B of FIG. 1.

An electrical connector part consists principally of a housing 1 produced of synthetic material, in which is included at least one receiving chamber 3 provided to receive an associated electrical connector contact element 2. In at least one outer housing wall of the housing 1 is located one orifice 4 per receiving chamber 3, with a locking arm 5 located therein and integrally formed on one side as a single piece with this outer housing wall.

Figure 5:
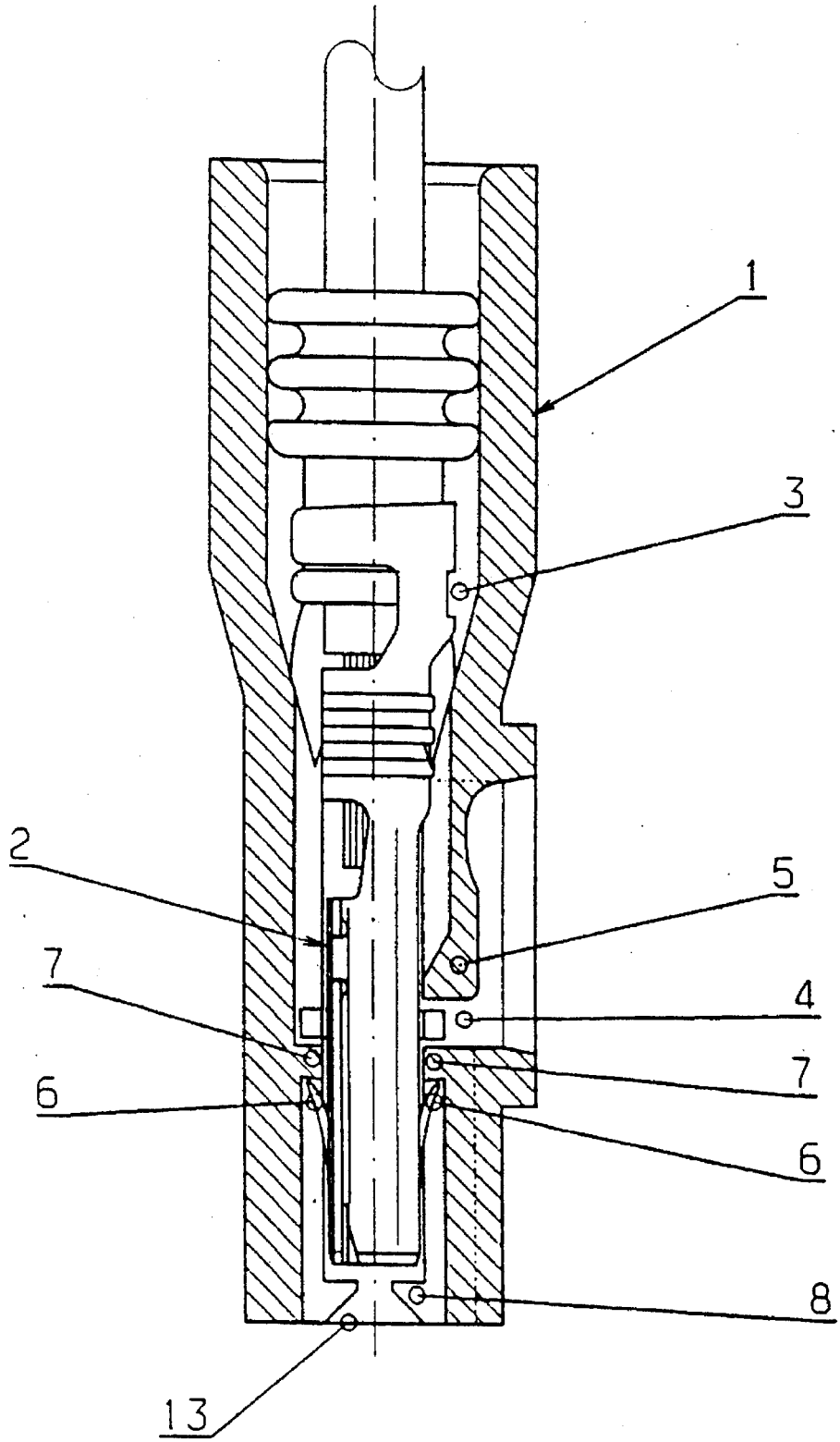
FIG. 5 illustrates a cross section through an electrical connector part corresponding to the line B—B of FIG. 1 but with a connector contact element.

The electrical connector contact elements 2 located in the receiving chambers 3 of the housing 1 must be held in a secure manner therein so that after connection of the connector part with its counter connector part the operating suitability thereof in ensured. To this end each connector contact element 2 comprises two integrally formed resilient arms 6 (FIGS. 5 and 6) which come to lie behind a respective locking stop 7 integrally formed on the walls of the associated receiving chamber 3. The two resilient arms 6 and the two locking stops 7 represent the so-called primary locking with respect to the necessary securing of the position of the electrical connector contact element 2. Furthermore, for the purpose of securing their position, each electrical connector contact element 2 is additionally securely held between an end stop 8, integrally formed at the mouth region 13 of the associated receiving chamber 3, and the locking arm 5 brought into its locking position. Thus the locking arm 5 coming into position with its free end on the electrical connector contact element 2 ensures secondary locking. Each locking arm 5 is integrally formed in a movable manner on an outer housing wall of the housing 1 by means of a film hinge 9. In the case of connector parts in a single row, all locking arms 5 are a component part of a single outer housing wall, whereas in the case of connector parts in two rows the locking arms 5 are component parts of two opposite outer housing walls of the housing 1.

Figure 3:
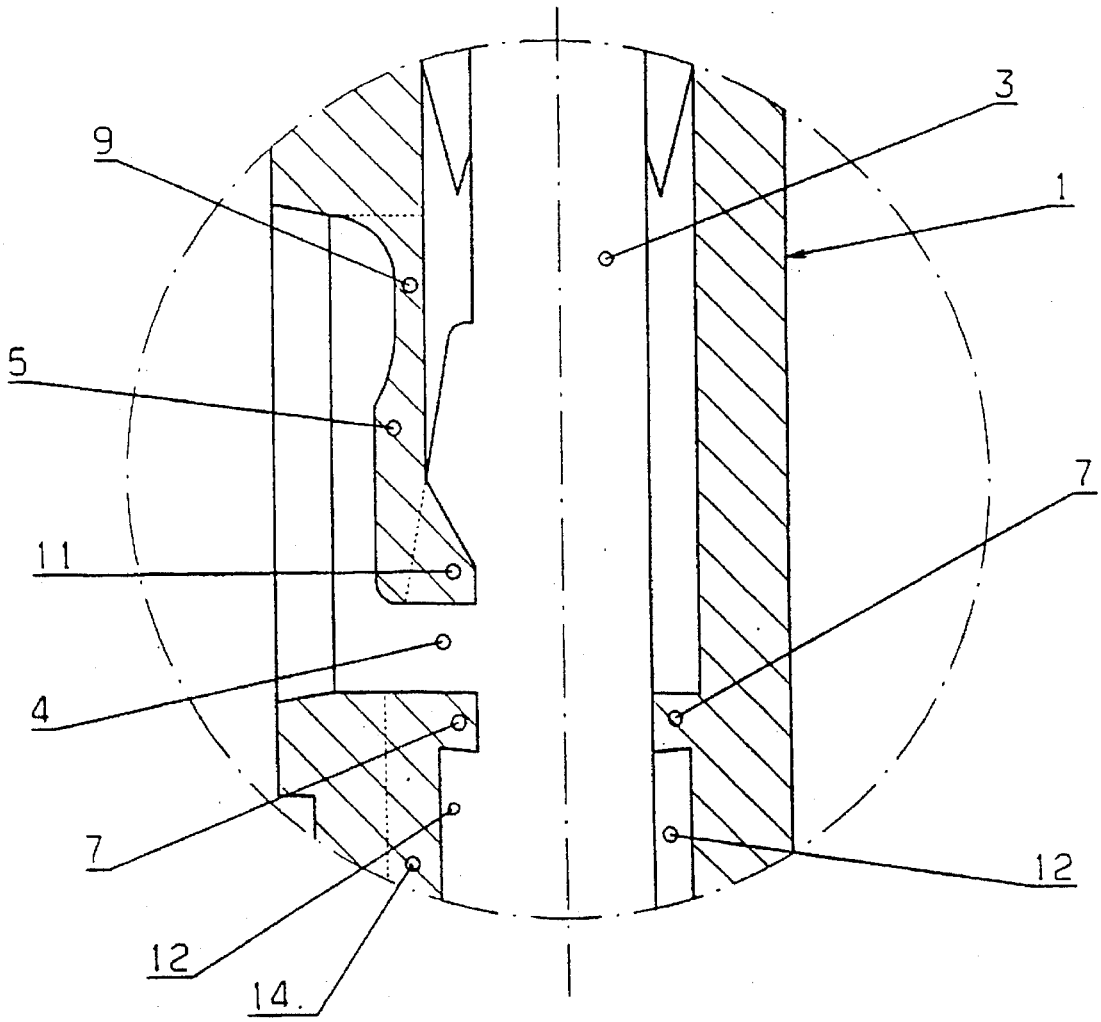
FIG. 3 illustrates the detail A marked in FIG. 2 on a larger scale.

For the sake of simplicity only a single receiving chamber 3 of the housing 1 is illustrated in the drawing. In order that an effective secondary locking is achieved the locking arm 5 is substantially formed as an L shape and comes to lie with its short limb behind securing stops 10 integrally formed on the associated connector contact element. As is particularly evident from FIG. 3 a return slope 11 is formed in the short limb of the locking arm 5, which in its contour substantially represents an extension of the long limb and which extends on one side over the entire width of the short limb. As is particularly evident from FIGS. 1 and 3 and FIG. 5, two groove-like access points 12 are formed in the receiving chamber 3. The two groove-like access points 12 lead from the mouth region 13 of the receiving chamber 3 and extend along two oppositely lying inner walls as far as the two integrally formed locking stops 7. Furthermore, in the housing 1 is formed a further access point 14 formed as a groove directed in as far as the orifice 4 and extending parallel to the receiving chamber 3. By means of these three access points 12, 14 the possibility arises of easily reaching both the resilient arms 6 of the primary locking and also the locking arm 5 of the secondary locking with a single tool 15. This is always necessary if a connector contact element 2 inserted into its receiving chamber 3 is to be removed therefrom again. Before the removal both the primary and the secondary locking of the connector contact element 2 must be released again.

Figure 4:
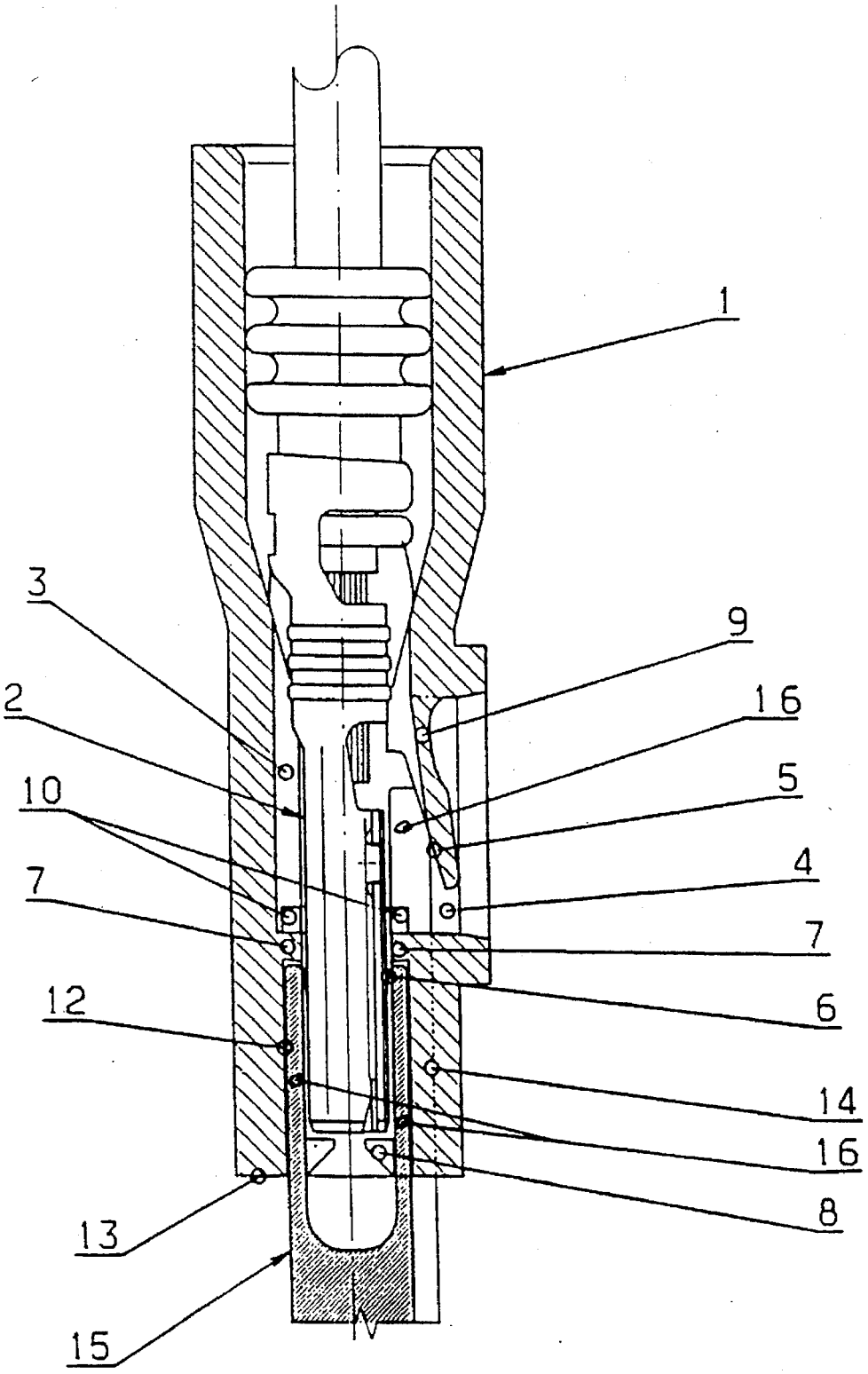
FIG. 4 illustrates a cross section through an electrical connector part corresponding to the line B—B of FIG. 1 but with a connector contact element and an inserted tool.

As is particularly evident from FIG. 4 the tool 15 is formed in a fork-like manner and comprises three fork prongs 16. In order to remove the connector contact element 2 from its receiving chamber 3 the tool 15 is inserted with its three fork prongs 16 into the housing 1. Two fork prongs 16 are thus inserted into the two groove-like access points 12 and thus finally force back the two resilient arms 6 of the connector contact element 2. Furthermore, at the same time one fork prong 16 is inserted into the other access point 14 and thus finally forces back the locking arm 5 out of its locking position into its release position. The return of the locking arm 5 is achieved because the fork prong 16 inserted into the other groove-like access point 14 firstly comes to bear with its free end on the return slope 11 and during further insertion of the tool 15 pushes the locking arm 5, using its return slope 11, more and more out of the cross sectional area of the receiving chamber 3. Finally the cross sectional area of the receiving chamber 3 is completely clear again so that the electrical connector contact element 2 can be quickly and easily removed from its receiving chamber 3 as a result of the simultaneous release of the primary and secondary locking.

In order to ensure a simultaneous removal of the primary and secondary locking of the electrical connector contact element 2, the fork prong 16 allocated to the other groove-like access point 14 is formed somewhat longer than the two remaining fork prongs 16.

While the best mode for carrying out the invention has been described in detail, those familiar with the art to which this invention relates will recognize various alternative designs and embodiments for practicing the invention as defined by the following claims.

What is claimed is:

1. An electrical connector part comprising:

a housing (1);

at least one receiving chamber (3) defined within the housing for an electrical connector contact element (2);

an orifice (4) located in an outer wall of the housing in communication with the receiving chamber (3);

a locking arm (5) disposed within the orifice on the outer wall of the housing that can be brought from a release position to a locking position and which in the release position clears a cross-sectional area of the receiving chamber and in the locking position narrows the cross-sectional area thereof so that the electrical connector contact element located therein is held under secondary locking between an associated end stop of the receiving chamber and an associated free end of the locking arm;

two exposed resilient arms (6) being integrally formed on the connector contact element, which come to lie behind locking stops (7) formed on the walls of the receiving chamber, so that the electrical connector contact element located in the receiving chamber is thereby held under primary locking;

two access points (12) defined in the housing leading from a mouth region (13) thereof and extending parallel to the longitudinal direction of the receiving chamber so that a tool (15) inserted into the housing through the two access points forces back the resilient arms of the connector contact element, thereby releasing the primary locking;

a return slope (11) formed on a free end region of the locking arm (5); and at least one further access point (14) being provided into the receiving chamber (3) leading from the mouth region (13) of the housing and extending substantially parallel to the longitudinal direction of the receiving chamber (3) so that the tool (15) is inserted into the housing (1) via the two access points and the other access point (12), thus contacting the return slope (11) and by means of a continuing insertion movement displacing the locking arm (5) from its locking position into its release position.

2. An electrical connector part according to claim 1 wherein the other access point (14) is formed in a groove-like manner.

3. An electrical connector part according to claim 1 wherein that the other access point (14) is formed in a channel-like manner.

4. An electrical connector part according to claim 1 wherein the locking stops (7) are provided on two oppositely lying walls of the receiving chambers (3) and the orifice (4) provided with the locking arm (5) being defined within one of these two walls.

5. An electrical connector part according to claim 1 wherein a single locking arm (5) is allocated to each receiving chamber (3).

6. An electrical connector part according to claim 1 wherein a common locking arm (5) is allocated to two receiving chambers (3).

7. An electrical connector part according to claim 1 wherein the tool (15) which is to be inserted into the access points (12,14) of the housing (1) is formed as a fork so that during insertion two fork prongs (16) contact the two resilient arms (6) of the connector contact element and one fork prong (16) contacts the locking arm (5) of the housing (1).

* * * * *